US006448880B2

(12) United States Patent
Yu

(10) Patent No.: US 6,448,880 B2
(45) Date of Patent: Sep. 10, 2002

(54) OVERLOAD-PROTECTION PUSH-BUTTON SWITCH WITH RETRACTABLE ACTUATING MECHANISM

(76) Inventor: Tsung-Mou Yu, No. 4, Alley 2, Lane 23, Sec. 3, Pa-Te Road, Pan-Chiao, Taipei Hsien (TW)

( * ) Notice: Subject to any disclaimer, the term of this patent is extended or adjusted under 35 U.S.C. 154(b) by 82 days.

(21) Appl. No.: 09/751,219

(22) Filed: Dec. 28, 2000

(30) Foreign Application Priority Data

Dec. 30, 1999 (TW) ..... 88222436 U

(51) Int. Cl.[7] ..... H01H 7/16; H01H 3/00

(52) U.S. Cl. ..... 337/66; 337/14; 337/68; 337/414; 200/339; 200/341

(58) Field of Search ..... 337/1, 3, 12, 13, 337/14, 16, 60, 66, 68, 70, 75, 113, 298, 362, 414, 415; 200/51 R, 52 R, 237, 252, 293, 329, 339, 341

(56) References Cited

U.S. PATENT DOCUMENTS 4,661,667 A 4/1987 Sorimachi et al.
4,704,594 A 11/1987 Krasser
4,931,762 A 6/1990 Fierro
4,937,548 A 6/1990 Sdunek
5,223,813 A 6/1993 Cambreleng et al.
5,451,729 A 9/1995 Onderka et al.
5,786,742 A 7/1998 Yin

*Primary Examiner*—Jayprakash N. Gandhi

(57) ABSTRACT

An overload-protection push-button switch with retractable mechanism is disclosed. The switch is characterized in that a retractable rocker actuator is used to actuate or release a conducting leaf. The rocker actuator comprises a main body and a sub-body. The sub-body is retractable with respect to the main body under a rotation action or a sliding action. When the bimetallic blade is in an overload position, the sub-body will be pushed and make the rocker actuator became disabled. As a result, the conducting leaf goes into a broken position. By means of the above structure, the trip action of the switch is assured and the space occupied by the rocker actuator is as small as possible under a condition without increasing the complication and loading of the bimetallic blade.

8 Claims, 17 Drawing Sheets

OVERLOAD-PROTECTION PUSH-BUTTON SWITCH WITH RETRACTABLE ACTUATING MECHANISM

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a push-button switch and, in particular, to an overload-protection push-button switch with a retractable actuating mechanism, in which a rocker actuator having a retractable body is disabled in case of overload so as to accomplish an overload-protection. The switch needs to be manually reset after overload.

2. Description of the Related Art

There are many types of push-button switches for various applications, such as one having a turn-on indicating lamp and one providing an overload protection function. In terms of one having an overload protection function, there are also several kinds of protection principles or mechanisms being adopted. For example, both the blowout of a fuse wire and the thermal deformation of a bimetal blade have ever been adopted as a trigger source for an overload protection. However, the fuse wire is not repetitive and thus its utility rate gradually decreases. As for the thermal bimetal blade, there are many kinds of mechanism, such as those disclosed in U.S. Pat. Nos. 5,786,742, 5,223,813, 4,937,548, 4,661,667, 4,931,762, 5,451,729, and 4,704,594.

For example, in the U.S. Pat. No. 5,786,742, a so-called power-cutting member (72) used to alternatively set a set and a reset position of a switch is disclosed. In that case, a bimetallic blade (75) is used to push a shaft seat (71) to trip and automatically reset a switch However, the contacts in such a switch are directly depressed by a button. Thus, if the button has jammed or pushed down by an external force, it would be kept in its conducting position even if overload occurs. Moreover, such a switch is not economical because of a use of up to four contacts to construct a conducting circuit. It also increases the possibility of generating an arc. Furthermore, it is troublesome in assembly due to a need for connecting a wire between the bimetallic blade (75) and the conducting plate (74).

Is In U.S. Pat. No. 5,223,813, there are a bimetallic blade (13), a common trip (17) actuated by the bimetallic blade, and a cam member (27) which is incorporated with a rocker actuator (33) to make contact members (7,1) contact together or separate from each other. In such a patent, the common trip (17) will be displaced in response to a deformation of the bimetallic blade so that the cam member (27) is released and the switch trips. However, even though the common trip is indirectly actuated by a rocker actuator so that a jamming of the rocker actuator or a contact of the contact members by a neglectful re-push after overload can be avoided, such a switch is rather complicated. Moreover, since it needs a wire to connect its cantilever spring (5) and its bimetallic blade (13), its assembly is also troublesome. Furthermore, a fail-action is possible in case of overload since the bimetallic blade may be unable to simultaneously actuate both of the rocker actuator (33) and the common trip (17).

In a circuit breaker disclosed in U.S. Pat. No. 4,937,548, a thermal actuator (76) is used to displace a lock lever (62) upon deformation so as to release a bell crank lever operator (52). In this case, even a jamming of the actuator and a connection between the contacts upon a neglectful re-push on the switch after overload can be avoided; such an arrangement is difficult to install an indicator therein. Moreover, since two thermal actuators are forced against one biasing spring, a tilt of the two thermal actuators may happen.

In U.S. Pat. No. 4,661,667, a double-heart-shaped cain locking mechanism is used to obtain two locking-positions. However, such a switch has not an overload protection function and a status-indicating function.

BRIEF SUMMARY OF THE INVENTION

A main object of the present invention is to provide an overload-protection push-button switch with a retractable actuating mechanism, which can make sure of a trip action in case of overload.

Another object of this invention is to provide an overload-protection push-button switch with a retractable actuating mechanism that occupies small space under a condition without increasing the complication and loading of the bimetallic blade.

To achieve the above objects of this invention, this invention provides an overload-protection push-button switch with a retractable actuating mechanism comprising a housing;

a switching circuit installed in the housing and including a first terminal, a second terminal, a first conducting leaf and a bimetallic blade; the bimetallic blade having a movable closed end, being able to move to an overload position from a normal position in case of overload, and an open end formed with a first and a second legs for respectively connecting the first terminal and the first conducting leaf; the first conducting leaf being movable between a conduction position in which the second leg of the bimetallic blade is electrically connected to the second terminal and a broken position in which the second leg is disconnected from the second terminal; and an actuating unit installed in the housing, including:

a slidable pressing stem to be actuated to one of a set and a reset positions;

a positioning unit including a cantilever and a heart-shaped stepping recess and being able to position the pressing stem in the set position when the pressing stem is pressed downward;

an enabling supporter provided on the housing;

a rocker actuator pivotally supported on the pressing stem, having a main body formed with a nose for abutting against the first conducting leaf, and a sub-body retractably coupling to the main body and formed with a toe portion to be supported by the enabling supporter, and an abutting portion to be pushed by the metallic blade;

an actuator-reseating member for abutting against the rocker actuator during the returning course of the pressing stem back to its reset position so that the toe portion can move into a position to be supported by the enabling supporter;

whereby the toe portion could be enabled by the enabling supporter and the nose can make the first conducting leaf be alternatively located in its conduction position and its broken position in response to the location of the pressing stem in the set position and in the reset position respectively when the bimetallic blade is in its normal position, and whereby the sub-body will retract so as to make the toe portion depart from the enabling supporter and to make the rocker actuator release the first conducting leaf into a broken position in case of overload.

By means of the above structure, since the conducting leaf is indirectly actuated, the switch can still exactly and transiently trip at the time overload occurs even if the stem jams. Moreover, since the trip action of the actuating mechanism is accomplished by the rocker actuator itself, the actuating mechanism will occupy a small space along with free of increasing the complication and loading of the bimetallic blade.

BRIEF DESCRIPTION OF THE SEVERAL VIEWS OF THE DRAWINGS

In the following, preferred embodiments of the present invention will be described in detail in conjunction with the accompanying drawings, wherein.

DETAILED DESCRIPTION OF THE INVENTION

In the following, an overload-protection push-button switch with a retractable mechanism in accordance with some preferred embodiments of this invention will be described in reference to the drawings.

Figure 1:
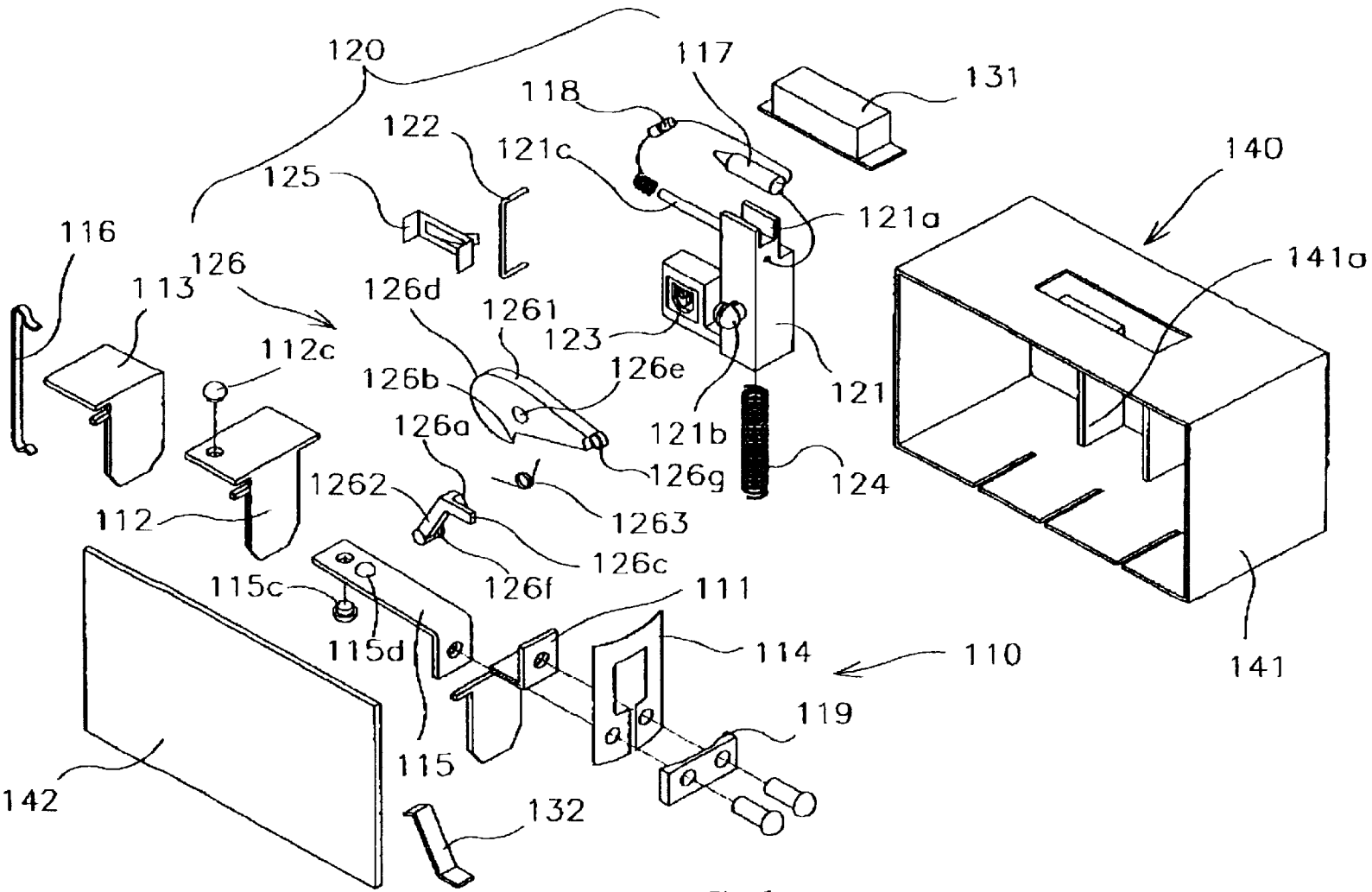
FIG. 1 is an exploded schematic perspective view of an overload-protection push-button switch with retractable actuating mechanism in accordance with a first embodiment of this invention.

As shown in the exploded perspective view of FIG. 1, the overload-protection push-button switch with a retractable actuating mechanism in accordance with a first preferred embodiment of this invention generally comprises a switching circuit 110, an actuating unit 120, and a housing 140 for receiving the switching circuit 110 and the actuating unit 120. The housing 140 comprises a main shell 141 and a cover 142. The switching circuit 110 comprises a first terminal 111, a second terminal 112, a third terminal 113, a thermal-deformed bimetallic blade 114, a first conducting leaf 115, a second conducting leaf 116, an indicating lamp 117, a resistor 118, and an insulating block 119 for fixing and angling the surfaces of two legs of the bimetallic blade 114. The actuating unit 120 comprises a pressing stem 121, a positioning unit mainly composed of a cantilever 122 and a heart-shaped stepping recess 123, a biasing spring 124 for biasing the pressing stem 121, a cantilever-biasing spring 125, a rocker actuator 126, an actuator-reseating member 129 (referring to FIG. 2), an enabling supporter 130 (referring to FIG. 2), a key 131 and a leaf-biasing spring 132. For the sake of convenience to description, the cover 142 is designated as front, the main shell 141 is designated as back the moving direction of the pressing stem from up to down is designated as a vertical direction, the direction from right side to left side is designated as a transverse direction, and the direction from front to back is designated as an axial direction in the following description.

The main shell 141 is provided with a top wall, a bottom wall and three sidewalls, and is formed with a key opening (not indicated with numeral) on the top wall and a number of terminal holes (not indicated with numeral) on the bottom wall. Moreover, a lot of members for guiding or fixing the elements mentioned above are formed integrally with the main shell 141. For example, a guiding wall 141*a* for guiding the pressing stem 121 is formed. The details of these members could be contemplated by one skilled in the art along with the following disclosure and thus their descriptions are omitted hereinafter for the sake of simplifying the description of embodiments.

Figure 2:
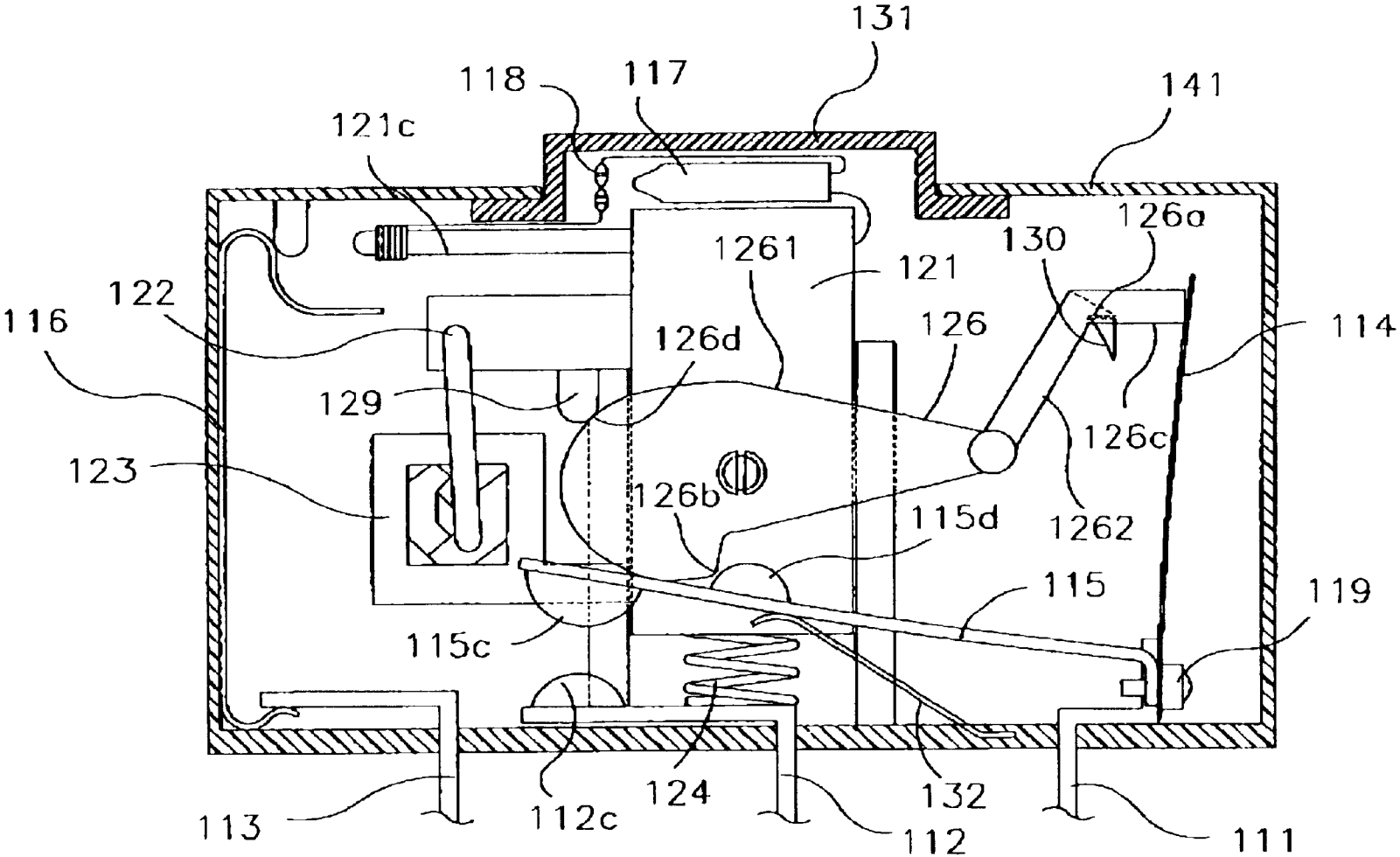
FIG. 2 is an assembled elevation view partly in section of the push-button switch of FIG. 1 in an OFF status.
Figure 4:
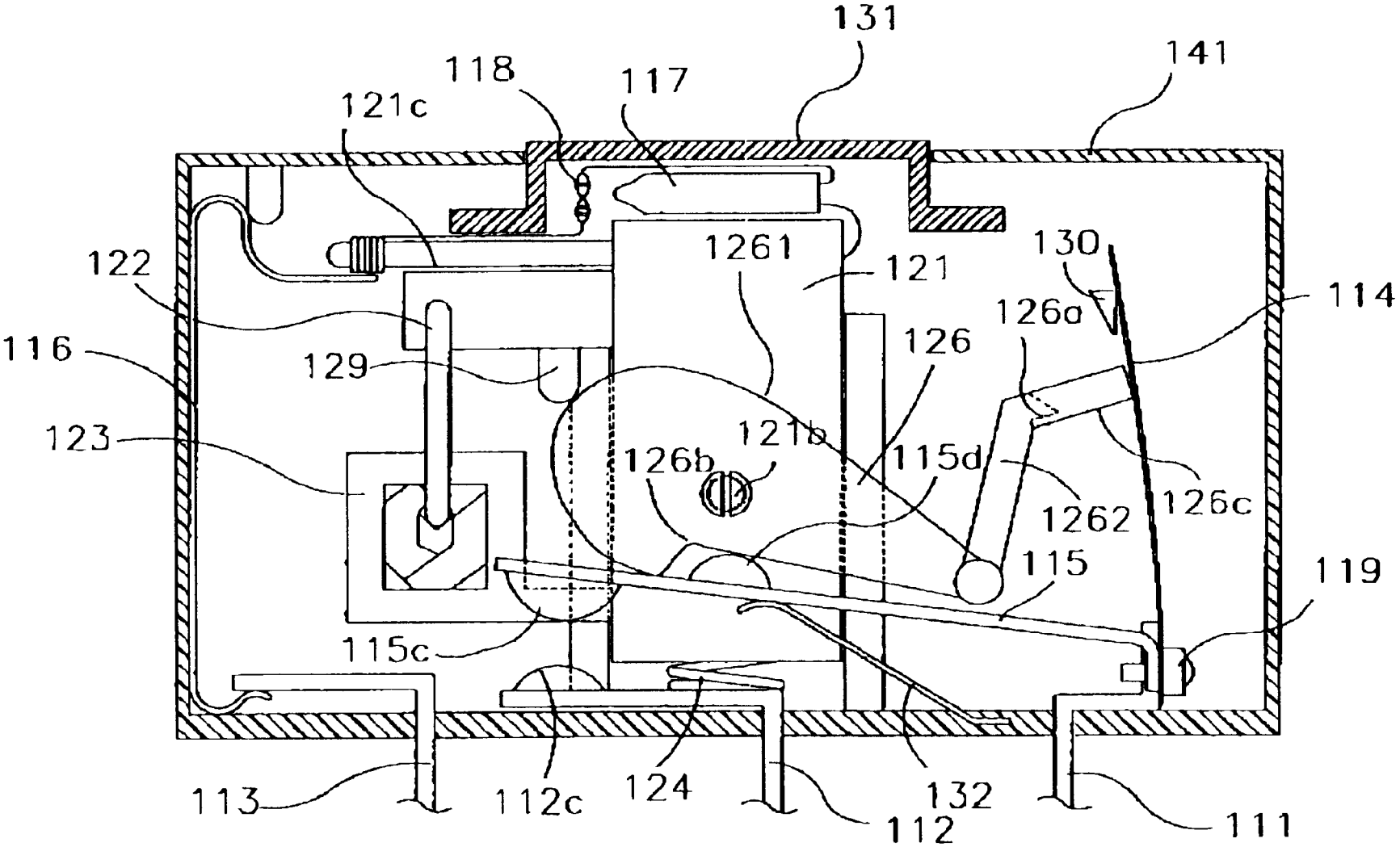
FIG. 4 is a view similar to FIG. 2 but in a trip status before the pressing stem returns to its reset position.

As shown in FIGS. 1 and 2, each terminal 111, 112 or 113 of the switching circuit 110 penetrates through respective terminal bole from inside to outside of the housing. The second terminal 112 is provided with a lower contact pad 112*c* inside the housing 1. The thermal-deformed bimetallic blade 114 is of a reversed-U shape having a closed end and an open end, The open end of the bimetallic blade 114 is constructed with two legs respectively being connected to the first terminal 111 and one end of the first conducting leaf 115 (as shown in FIG. 1). The is two legs of the bimetallic blade 114 are fixed and angled to each other by the insulating block 119. The thermal-deformed bimetallic blade 114 is in a normal position as shown in FIG. 2 if the current passing there through is not in overload, while the bimetallic blade 114 is in an overload position as shown in FIG. 4 if the current passing there through is in overload. Once overload disappears, the bimetallic blade 114 will automatically return to its normal position from its overload position. By means of angling the surfaces of the two legs, the bimetallic blade 114 will snap to deform quickly.

The first conducting leaf 115 is fixed and electrically connected to the bimetallic blade 114 (as shown in FIG. 1) at one end thereof and is provided with an upper contact pad 115*c* at its free end so as to contact a lower contact pad 112*c* of the second terminal 112. Moreover, the first conducting leaf 115 is further provided with a dome 115*d* at its substantially middle portion so as to be abutted by the actuating unit 120.

Figure 3:
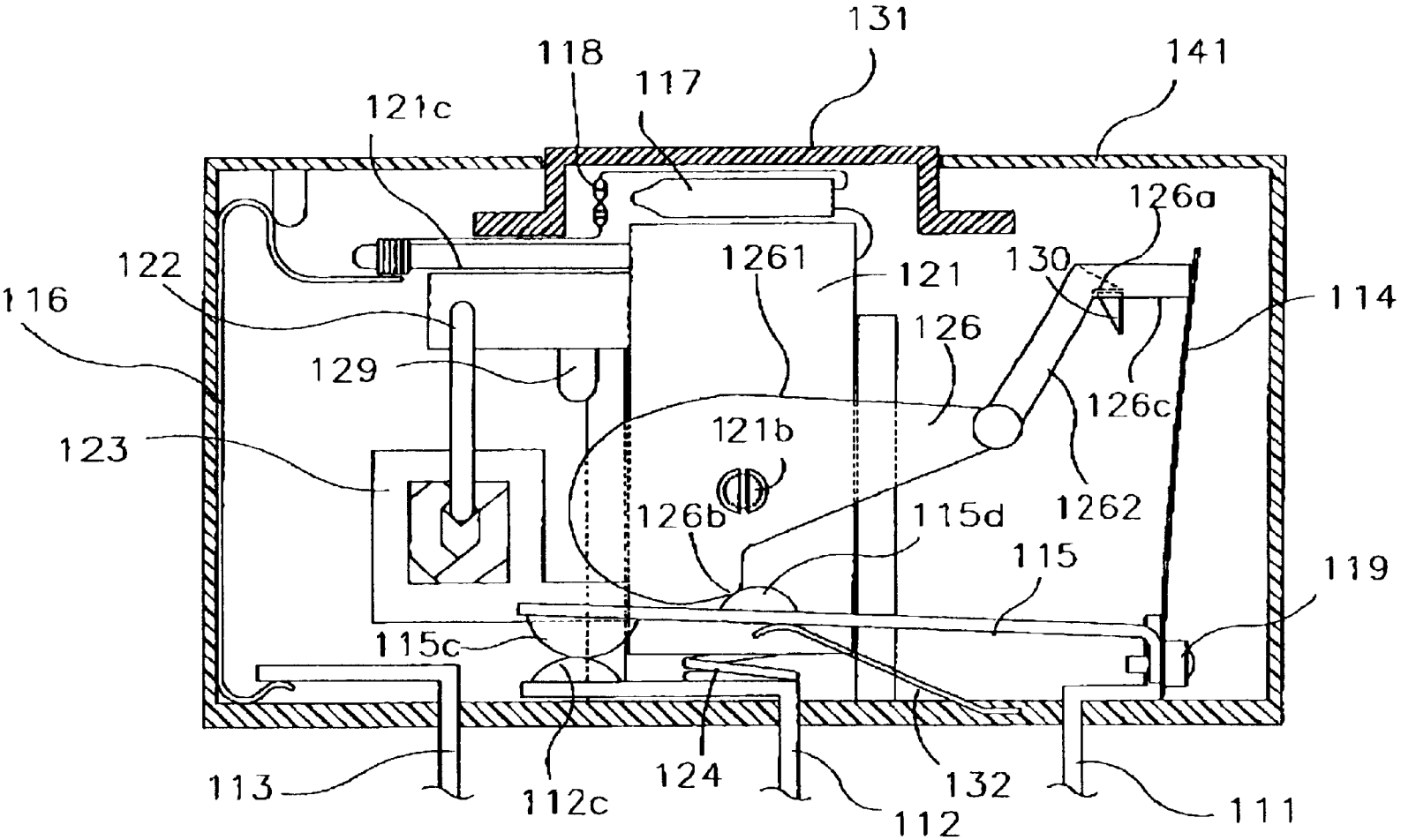
FIG. 3 is a view similar to FIG. 2 but in an ON status.

As shown in FIGS. 1 and 2, the second conducting leaf 116 has a fixed end electrically connected to the third terminal 113 and a free end to be contacted by the resistor 118 (as shown in FIG. 3). The resistor 118 is connected with one pin of the indicating lamp 117 located in a trench 121*a* at the upper portion of the pressing stem 121. The other pin of the indicating lamp 117 passes through a hole formed in the pressing stem 121 and electrically connects with the second terminal 112 via the biasing spring 124 received in the pressing stem 121.

By means of the above, when the first conducting leaf 115 is actuated by the actuating unit 120 and moves into a conduction position as shown in FIG. 3, an electrical contact is built between the upper and lower contact pads 115*c* and 112*c*. Thus, the power from the first terminal 1i1 will be transmitted to the second terminal 112 and to the third terminal 113 via the indicating lamp 117 so as to light up the indicating lamp 117.

As shown in FIGS. 1 and 2, the pressing stem 121 of the actuating unit 120 is of a square hollow shape in which a biasing spring 124 is received and thus the pressing stem 121 is biased upward to a reset position (as shown in FIG. 2) by the biasing spring 124. The upper portion of the pressing stem 121 is further provided with an arm 121*c* extending from its upper sidewall for carrying one pin of the resistor 118 to contact the second conducting leaf 116. The pressing stem 121 is further provided with a snap shaft 121*b* on its front side surface for pivoting the rocker actuator 126. The heart-shaped stepping recess 22*b* is formed in a block integrally formed with the pressing stem 121 at its right side and faces front. In the heart-shaped stepping recess 22*b*, a locking arch is formed at its upper portion.

The cantilever 122 of the positioning unit is constructed by a steel wire having proper flexibility and rigidity. A flexed end of the cantilever 122 is fixed on the main shell 141 and a free end thereof is inserted into the heart-shaped stepping recess 123 under a biasing of the cantilever-biasing spring 125. The detailed description of the heart-shaped stepping recess 22*b* is disclosed in the U.S. Pat. No. 5,786,742 and thus is omitted herein. The content of the U.S. Pat. No. 5,786,742 is incorporated herein for reference. The free end of the cantilever 22*a* will move into the upper locking arch when the pressing stem 121 is pressed downward, and thus keep the pressing stem 121 in a set position. However, if the pressing stem 121 is pushed again, the free end of the cantilever 122 will escape the upper locking arch and release the pressing stem 121 back to the reset position.

The rocker actuator 126 comprises a main body 1261, a sub-body 1262 and a body-biasing spring 1263. The main body 1261 is formed with a pivoting hole 126*e* to be pivotally supported by the snap shaft 121*b*, a nose 126*b* for abutting against the first conducting leaf 115, a reseating shoulder 126*d* for engaging with the actuator-reseating member 129, and a axial hole 126*g* serving as a first joint for coupling with the sub-body 1262. The sub-body 1262 is formed with a toe portion 126*a* for resting on the enabling supporter 130, an abutting portion to be pushed by the bimetallic blade 114, and a shaft 126*f* serving as a second joint for coupling with the main body 1261. The body-biasing spring 1263 is mounted on the shaft 126*f* so as to retractably bias the abutting portion 126*c* of the sub-body 1262 to depart from the main body 1261.

The actuator-reseating member 129, as shown in FIG. 2, is integrally formed in the main shell 141 in parallel to the axis of the snap shaft 121*b*. The actuator-reseating member 129 is located in a position such that the rocker actuator 126 will rotate and make the toe portion 126*a* go into a position to be supported by the enabling supporter 13 when the pressing stem 121 returns to its reset position.

By means of the above construction, as shown in FIG. 2, when the bimetallic blade 114 is in a normal position, the toe portion 126*a* rests on the enabling supporter 130 and thus the rocker actuator 126 is enabled.

This is because the abutting portion 126*c* is not pushed by the bimetallic blade 114 and thus the sub-body 1262 is biased rightward, preferred up to a maximum point, so that the toe portion 126*a* can rest on the enabling supporter 130. Moreover, when the pressing stem 121 is located in an upward reset position, the free end of the cantilever 122 is unlocked, the shoulder 126*d* engages with the actuator-reseating member 129, and the first conducting leaf 115 is free to be pressed down by the nose 126b and thus in a broken position, as shown in FIG. 2. Moreover, the indicating lamp 117 is turned off due to the failure of the resistor 118 to contact the second conducting leaf 116.

On the other side, when the pressing stem 21 is pushed down while the bimetallic blade 114 is in a normal position as shown in FIG. 3, the nose 126*b* will press the fist conducting leaf 115 down so that an electrical contact is built between the upper contact pad 115*c* and the lower contact is pad 112*c*. Moreover, since the free end of the cantilever 122 is locked by the locking arch in the heart-shaped stepping recess 123, the pressing stem 121 will be kept in its set position. As a result, the first conducting leaf 115 is in a conduction position and the indicating lamp 117 is turned on. In other words, the nose 126*b* of the rocker actuator 126 can actuate or release the first conducting leaf 115 into a conduction position, as shown in FIG. 3, or a broken position, as shown in FIG. 2, respectively in response to the pressing stem 121 in either a set position or a reset position.

However, when the bimetallic blade 114 is deformed to an overload position as shown in FIG. 4 owing to overload, the abutting portion 126*c* will be pushed by the closed end of the bimetallic blade 114. As a result, the sub-body 1262 retracts inward and the toe portion 126*a* departs from the enabling supporter 130. Subsequently, the press of the nose 126*b* on the first conducting leaf 115 is disabled. The rocker actuator 126 then clockwise rotates so that the first conducting leaf 115 is permitted to return to its broken position under the action of the leaf-biasing spring 132. In the meanwhile, the indicating lamp 117 is turned off.

After the switch trips, the pressing stem 121 and the rocker actuator 126 are in a set position and a disabled position as shown in FIG. 4 respectively. Under such a situation, even the bimetallic blade 114 returns to its normal position, each of these two parts still keeps in such a position until the switch is manually reset, i.e., the pressing stem 121 is pushed again so as to return to its reset position.

Therefore, when the pressing stem 121 is pushed again, the free end of the cantilever 122 will depart from the locking arch of the heart-shaped stepping recess 123 so as to permit the pressing stem 121 to return to its reset position. During the course of reset, the rocker actuator 126 is moved upward and counterclockwise rotates due to the engagement of the shoulder 126*d* with the reseating member 129. As a result, the toe portion is 126*a* will slide over a lower oblique surface of the enabling supporter 130 and rest on an upper surface of the enabling supporter 130. Thus, the rocker actuator 126 is enabled again, By the way, it should be understood that no matter either the pressing stem 121 is first reset or the bimetallic blade 114 first returns to its normal position, the toe portion 126*a* always can rest on the enabling supporter 130 so as to enable the rocker actuator 126.

By means of the above structure, the push-button switch according to this invention can provide an exact overload-protection function in case of overload. And, since the rocker actuator 126 is provided with a retractable mechanism, the space occupied by the actuating unit is very small on a condition of meeting both of the above function and freedom from increasing the complication and loading of the bimetallic blade 114.

Figure 5:
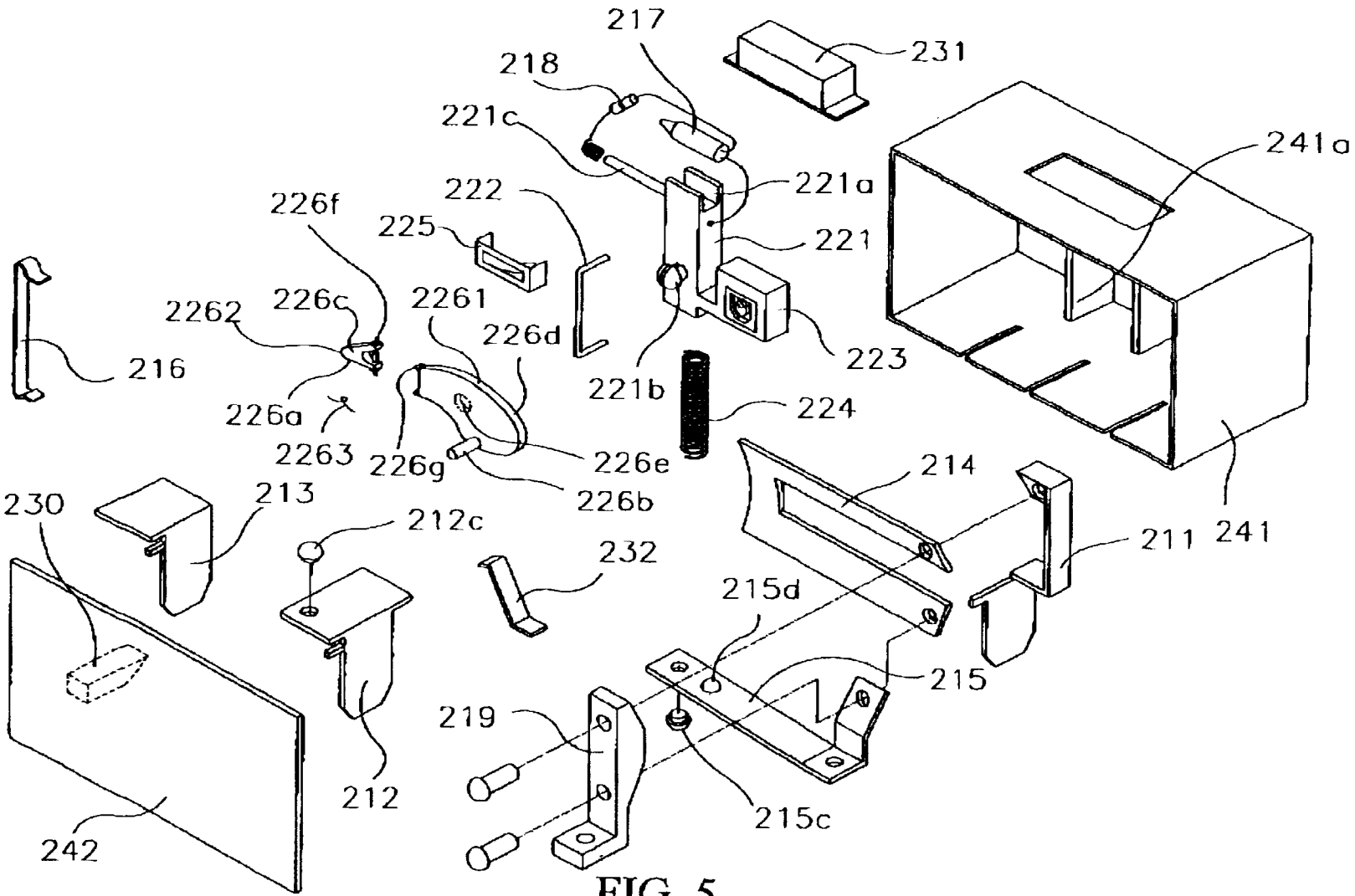
FIG. 5 is an exploded schematic perspective view of an overload-protection push-button switch with retractable actuating mechanism in accordance with a second embodiment of this invention.
Figure 6:
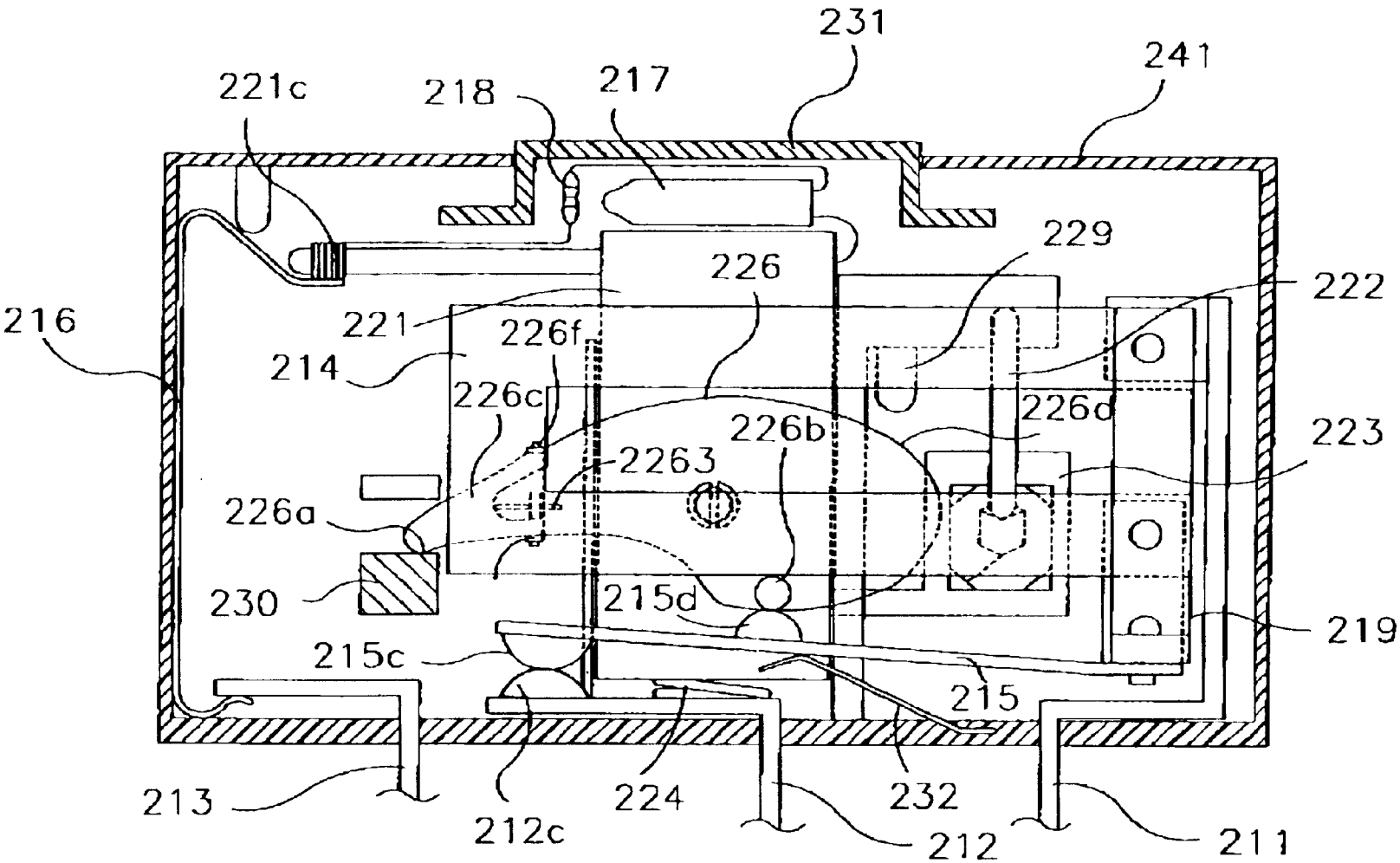
FIG. 6 is an assembled elevation view partly in section of the push-button switch of FIG. 1 in an ON status.
Figure 7:
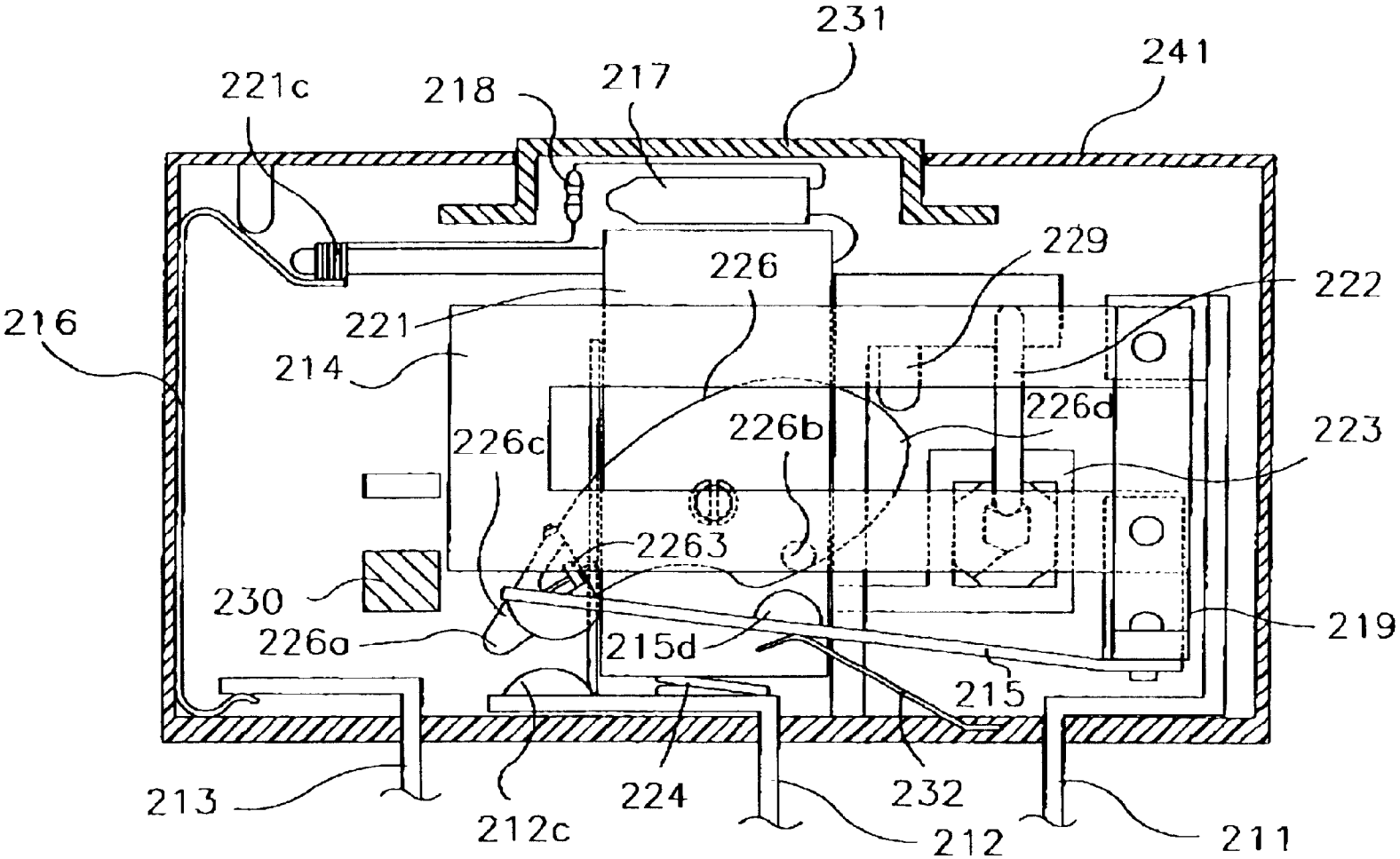
FIG. 7 is a view similar to FIG. 6 but in a trip status before the pressing stem returns to its reset position.

FIGS. 5 to 7 show an overload-protection push-button switch with a retractable mechanism in accordance with a second embodiment of this invention. Basically, the description of the element corresponding to that in the first embodiment will be omitted for the sake of simplifying the description of this specification.

As shown in FIG. 5, the difference of the second embodiment from the first embodiment comprises the following. The bimetallic blade 214 transversely extends over the front of the pressing stem 221. The closed end of the bimetallic blade 214 is located at left side of the drawing while the open end thereof is located at right side of the drawing. The two legs of the closed end are fixed by an insulating block 219 to angle frontward to each other at a small degree. Moreover, the sub-body 2262 is of a substantial U-shape horizontally opening rightward. The sub-body 2262 is formed with a toe portion 226*a* on its lower edge and an abutting portion 226*c* on its front side surface. The sub-body 2262 is further provided with two vertical pins 226*f* respectively on its upper and lower edge at its right side, which serves as a second joint The main body 2261 is formed with two pinholes 226*g* at the boundary to the sub-body 2262 so as to receive the two pins 226*f*. The two pinholes 226*g* serve as a first joint. By means of the join of the first joint and the second joint, the sub-body 2262 will be biased frontward around the pins 226*f* in relative to the main body 2261. Furthermore, the nose 226*b* of the main body 2261 in this embodiment is a form of an axially extending rod. The heart-shaped stepping recess 223 in this embodiment is formed in a block integrally formed at the right side of the pressing stem 221, and faces front, The enabling supporter 230, as shown in FIG. 6, is in a form of a post extending from the cover 242. The post has a free end portion capable of supporting the toe portion 226*a*. The other parts in this embodiment are substantially the same as those in the first embodiment except a slight change in shape, and thus their description is omitted herein.

As shown in FIGS. 6 and 7, when the bimetallic blade 214 is in an normal position, the abutting portion 226*c*, i.e. the front side surface, of the so sub-body 2262 of the rocker actuator 226 is not pushed backward by the closed end of the bimetallic blade 214. The toe portion 226*a* is thus supported by the enabling supporter 230 so that the rocker actuator 226 is enabled. In such a situation, like the first embodiment does, the switch can be turned on or off.

When the bimetallic blade 214 is in an overload position, the closed end of the bimetallic blade 214 will move backward and push the sub-body 2262 to rotate backward around the pins 226*f*. As a result, the toe portion 226*a* will depart from the enabling supporter 230 so as to disable the rocker actuator 226. The rocker actuator 226 then rotates counterclockwise into a disabled position as shown in FIG. 7. Subsequently, the first conducting leaf 215 is out of contacting the second terminal 212 and goes into a broken position. The indicating lamp 217 is also turned off.

Like the first embodiment does, the switch needs to be manually reset. The pressing stem 221 and the rocker actuator 226 do not return to its reset position and its enabled position until the switch is manually reset. By the way, the sub-body 2262 will slide over a lower oblique surface of the enabling supporter 230 during its return to the supported position.

Figure 8:
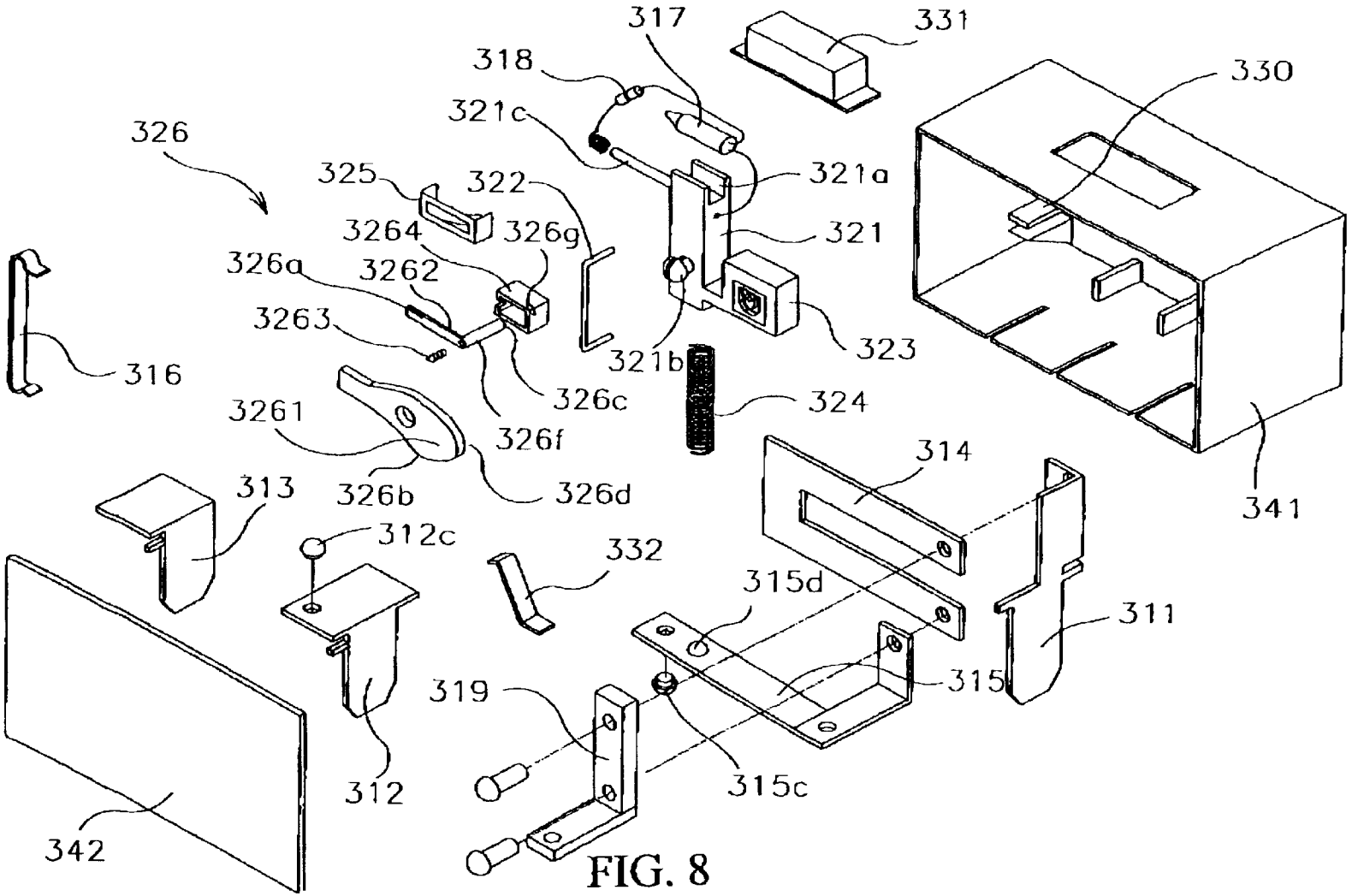
FIG. 8 is an exploded schematic perspective view of a switch in accordance with a third embodiment of this invention.
Figure 9:
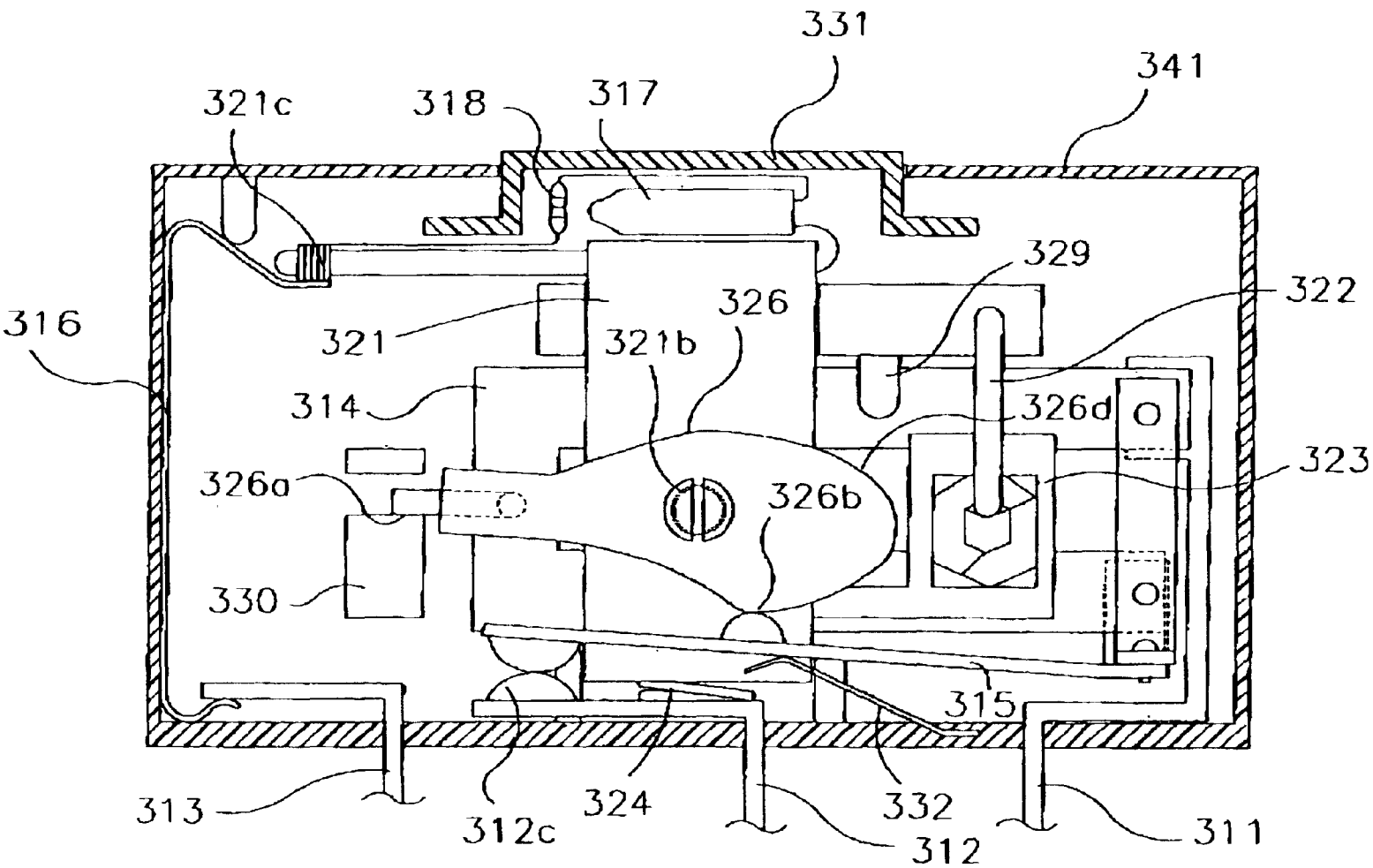
FIG. 9 is an assembled elevation view partly in section of the push-button switch of FIG. 8 in an ON status.
Figure 10:
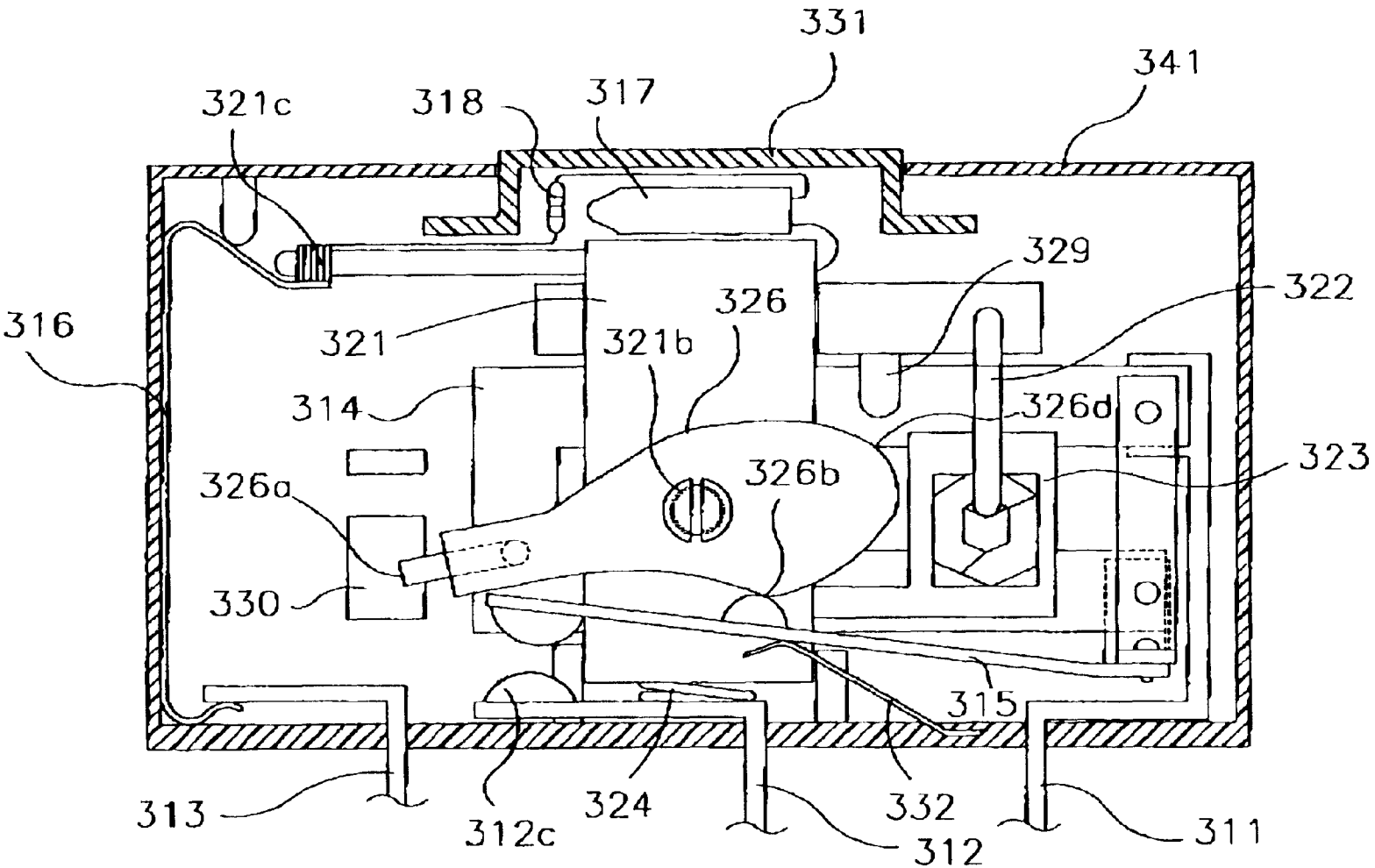
FIG. 10 is a view similar to FIG. 9 but in a trip status before the pressing stem returns to its reset position.

FIGS. 8 to 10 show an overload-protection push-button switch with a retractable mechanism in accordance with a third embodiment of this invention.

In comparison with the second embodiment, the bimetallic blade 314 in this embodiment also extends transversely but is positioned after the pressing stem 321. The enabling supporter 330 in this embodiment frontward extends from the back sidewall of the main shell 341 and is formed with a lower oblique surface. The sub-body 3262 in this embodiment is in a form of a crank having one side 326*a* of a slat shape and the other side 326*f* of a shaft shape. The free end of the slat-shaped side 326*a* of the sub-body 3262 is formed with a toe portion 326*a* on its lower edge. The end of the shaft-shaped side 326*f* of the sub-body 3262 serves as an abutting portion 326*c* to be pushed by the bimetallic blade 314. The shaft-shaped side 326*f* of the sub-body 3262 serves as a second joint. The main body 3261 comprises a box 3264 for receiving the sub-body 3262, in which an axial hole 326*g* for the pass of the shaft-shaped side 326*f* of the sub-body 3262 is formed, which serves as a first joint. The sub-body 3262 is biased backward by a coil spring 3263 installed between a surface of the main body 3261 and the shaft-shaped side 326*f* of the sub-body 3262. The end of the shaft-shaped side 326*f* facing the coin spring 3263 is preferably formed with a hole for receiving one end of the coil spring 3263. As the other parts in this embodiment are substantial the same as those in the second embodiment and their related description is omitted herein only for simplifying the description of this specification.

According to the above third embodiment, as shown in FIGS. 9 and 10, when the bimetallic blade 314 is in a normal position, the sub-body 3262 is axially biased backward by the coil spring 3263 and thus the toe portion 326*a* is supported on the enabling supporter 330. As a result, the rocker actuator 326 is enabled and thus can actuate or release the first conducting leaf 315 into a conduction position or a broken position in response to the moving of the pressing stem 321 into a set or a reset position.

On the other hand, when the bimetallic blade 314 is in an overload position, the closed end of the bimetallic blade 314 will deform frontward and thus push the shaft-shaped side 326*f* of the sub-body 3262 axially frontward. As a result, the shaft-shaped side 326*f* of the sub-body 3262 axially retracts into the box 3264 and the toe portion 326 therefore departs from the enabling supporter 330. Subsequently, the rocker actuator 326 rotates into a disabled position as shown in FIG. 10. The first conducting leaf 315 therefore goes into a broken position and the indicating lamp 317 is turned off.

Like the second embodiment does, the above trip status will be sustained until the switch is manually reset. That is, when the pressing stem 321 is pushed, it will return to its reset position because the free end of the cantilever 322 departs from the locking arch of the heart-shaped stepping recess 323. In the meanwhile, the toe portion 326*a* will slide over the lower oblique surface of the enabling supporter 330 and rest on the enabling supporter 330 again. Of course, such a resting comes to be true only as the bimetallic blade 314 return to its normal position.

Figure 11:
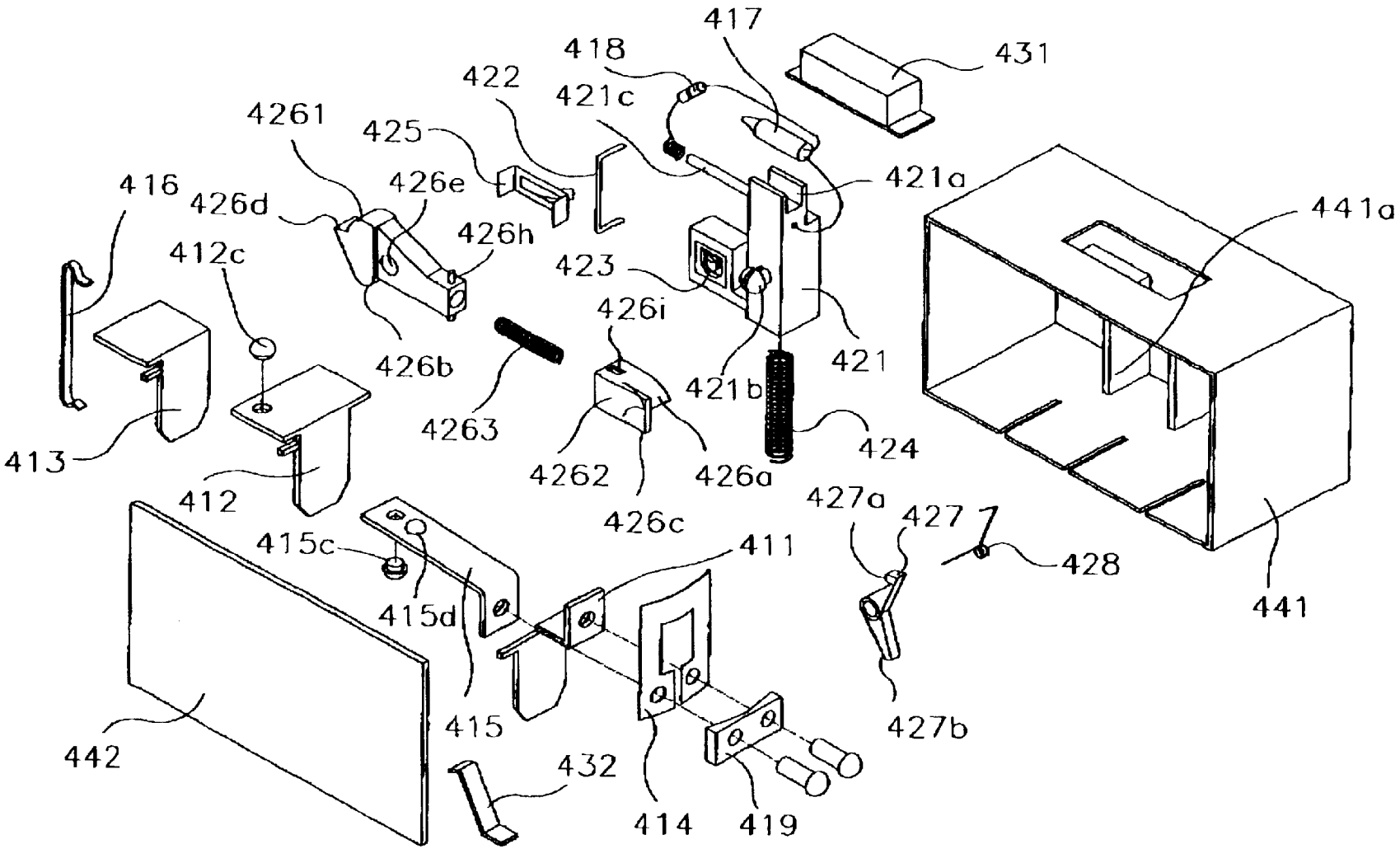
FIG. 11 is an exploded schematic perspective view of a switch in accordance with a fourth embodiment of this invention.
Figure 12:
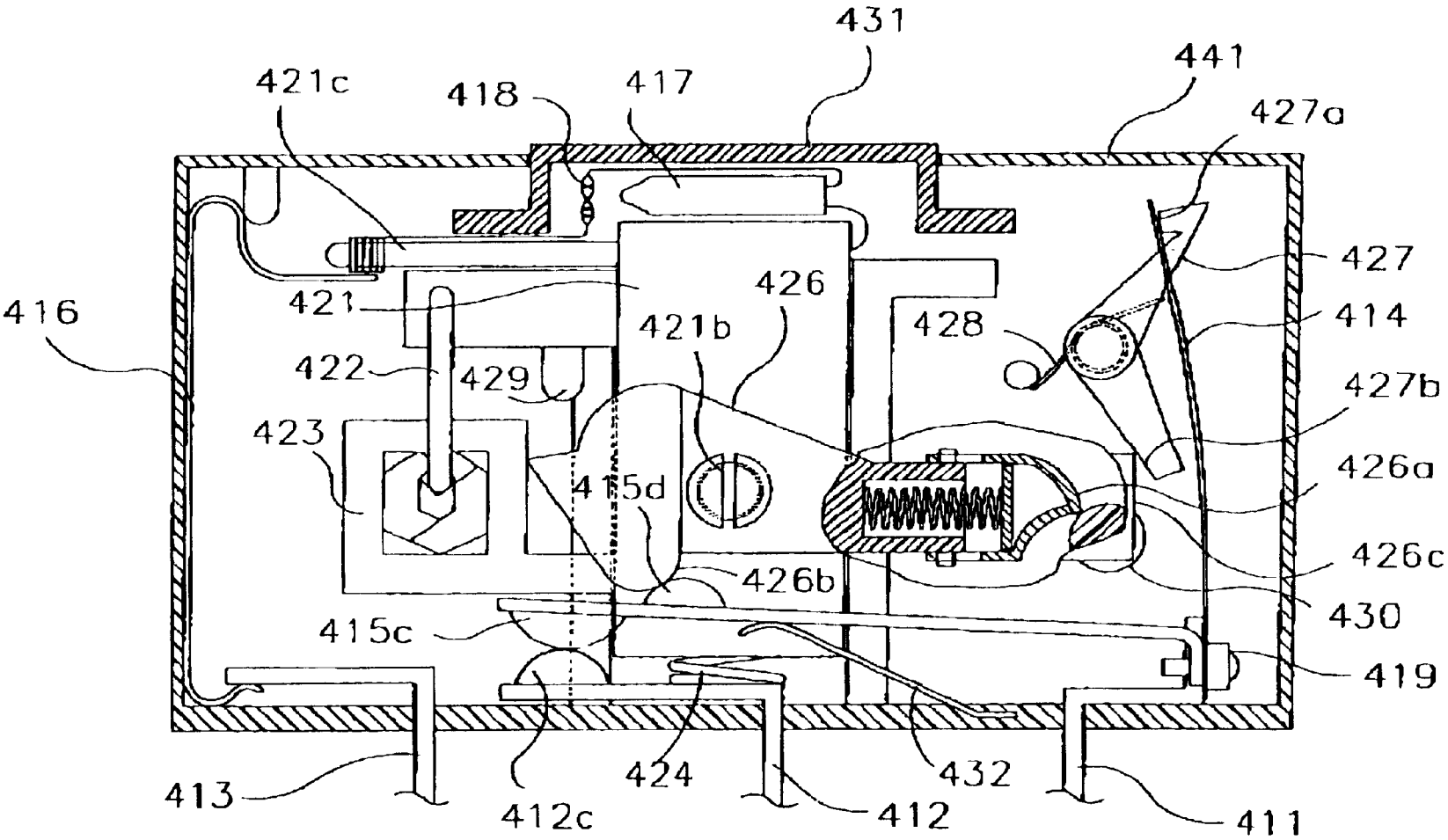
FIG. 12 is an assembled elevation view partly in section of the push-button switch of FIG. 11 in an ON status.
Figure 13:
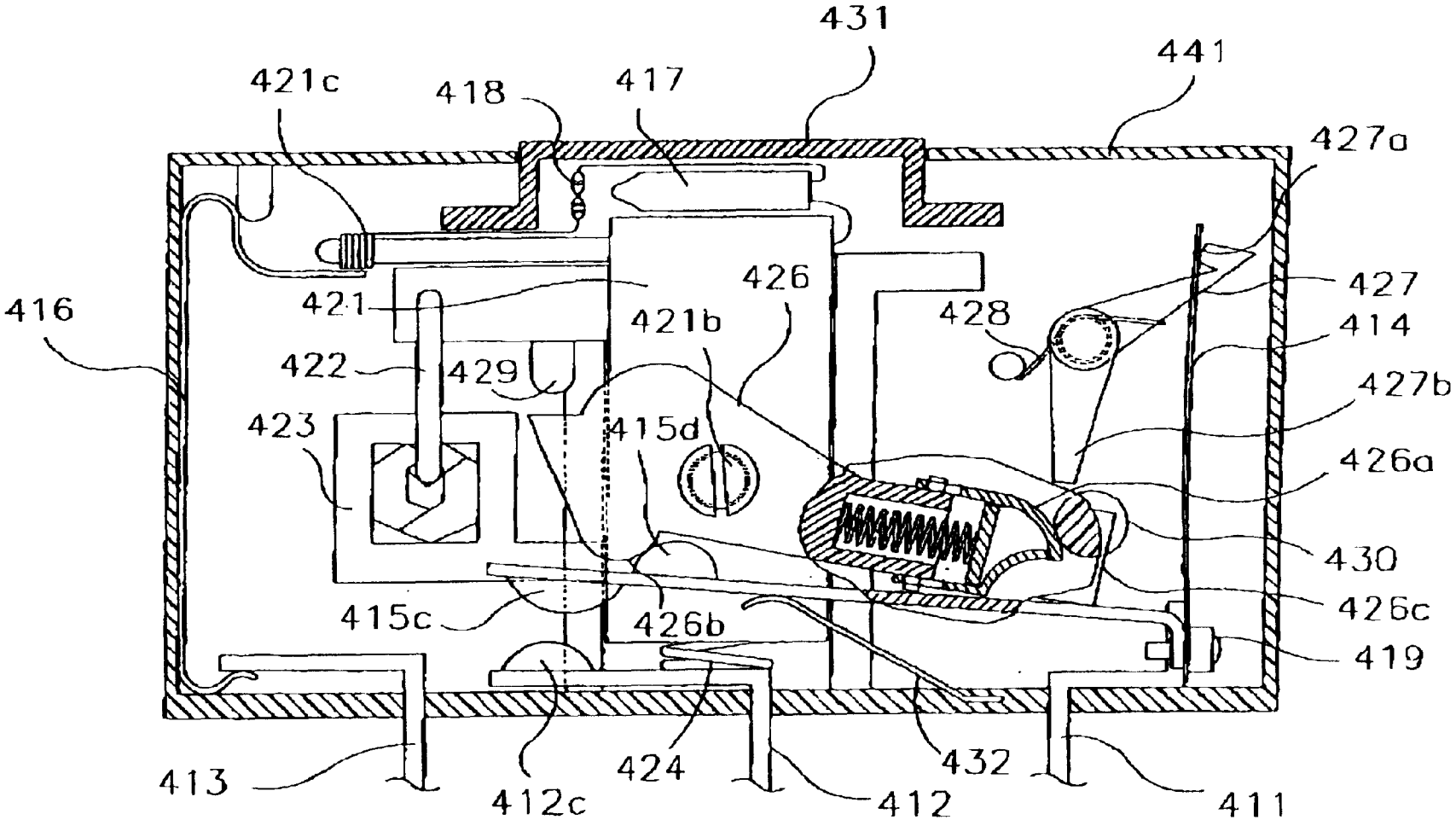
FIG. 13 is a view similar to FIG. 12 but in a trip status before the pressing stem returns to its reset position.

FIGS. 11 to 13 show an overload-protection push-button switch with a retractable mechanism in accordance with a fourth embodiment of this invention.

In comparison with the first embodiment most of the parts in this embodiment are substantially the same as those in the first embodiment and thus their description is omitted herein only for the sake of description simplification. The main difference between the first embodiment and this embodiment is the structure of the rocker actuator 426 and an additional transmittal lever 427 as well as its biasing spring 428. Moreover, the bimetallic blade 414 in this embodiment will deform rightward in case of overload.

As shown in FIG. 11, the rocker actuator 426 also comprises a main body 4261 and a sub-body 4262. The main body 4261 is of a shape as shown in FIGS. 11 and 12 and is formed with a nose 426*b* and a shoulder 426*d* at one end thereof, a pivot hole 426*e,* a pair of shafts 426*h* vertically formed on the other plug-shaped end thereof to serve as a first joint, and a first recess formed in the plug-shaped end with opening to the sub-body side so as to receive the biasing spring 4263. The sub-body 4262 is of a shape as shown in FIGS. 11 and 12 and is formed with a toe portion 426*c* of an arc-shape, an abutting portion 426*c* of a shape of a vertical plate, a pair of guiding holes 426*i* for matching with the shaft 426*h* and serving as a second joint, and a second recess for receiving the biasing spring 4263. The guiding holes 426*i* are formed on the wall defining the recess for receiving the biasing spring 4263. The combination of the main body 4261 and the sub-body 4262 is shown in FIG. 12 in sectional view, As shown in FIG. 12, the toe portion 426*c* can rest on the enabling supporter 430 extending from the main shell 441 with its end edge. The abutting portion 426*c* extends over and before the enabling supporter 430 and can be pushed by the transmittal lever 427 on its end edge. The biasing spring 4263 has two ends respectively abutting against the bottom of the first and the second recess.

The transmittal lever 427 is pivoted on the housing and has at its two ends an input portion 427*a* for contact the closed end of the bimetallic blade 414 and an output portion 427*b* for actuating the abutting portion 426*c* respectively. The transmittal lever 427 is biased by the biasing spring 428 to a normal position as shown in FIG. 12.

By means of the above structure, the ON/OFF action of the switch is substantially the same as that in the other embodiments. As for the trip action in this embodiment, it can be briefly described as follows. That is, when the bimetallic blade 414 is in an overload position, the closed end thereof will actuate the input portion 427*a* of the transmittal lever 427 to move rightward, and thus the output portion 427*b* of the transmittal lever 427 will move leftward. As a result, the abutting portion of the sub-body 4262 is pushed leftward and subsequently the toe portion 426*a* departs from the enabling supporter 430. The rocker actuator 426 therefore rotates clockwise and goes into a disabled position, as shown in FIG. 13. The first conducting leaf 415 thus goes into a broken position. The trip action of the switch is completed.

Later, when the switch is manually reset, an arc surface of the toe portion 426*a* of the sub-body 4262 will slide over the enabling supporter 430, under a counter to the biasing spring 4263, along with the moving-up of the pressing stem 421 and the engagement of the shoulder 326*d* with the actuator-reseating member 429. Subsequently, the toe portion 426*a* rests on the enabling supporter 430 with its end edge. The rocker actuator 426 is thus enabled. Like the other embodiments do, such a reset action cannot be completed until the bimetallic blade 414 returns to its normal position.

Figure 14:
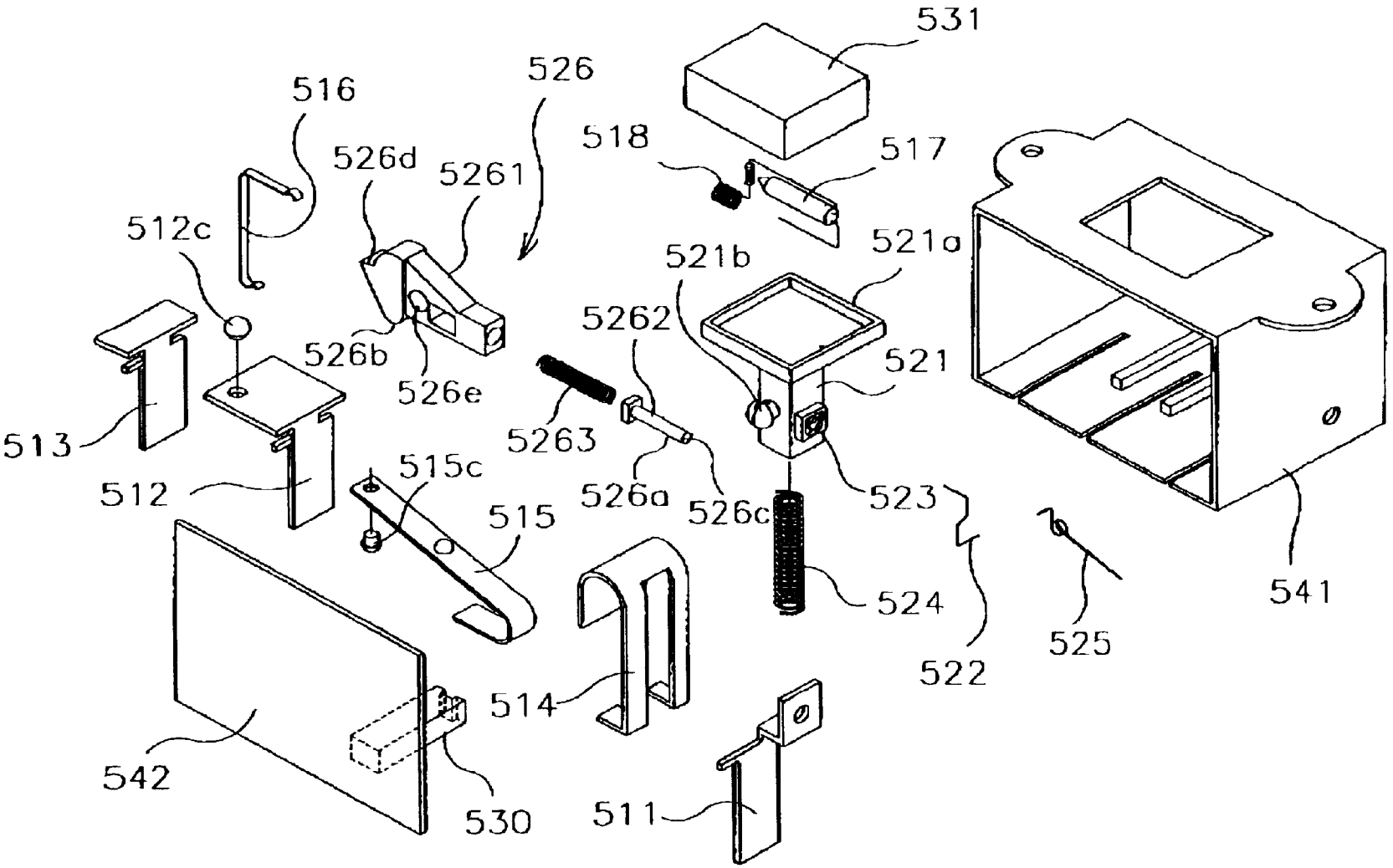
FIG. 14 is an exploded schematic perspective view of a switch in accordance with a fifth embodiment of this invention.
Figure 15:
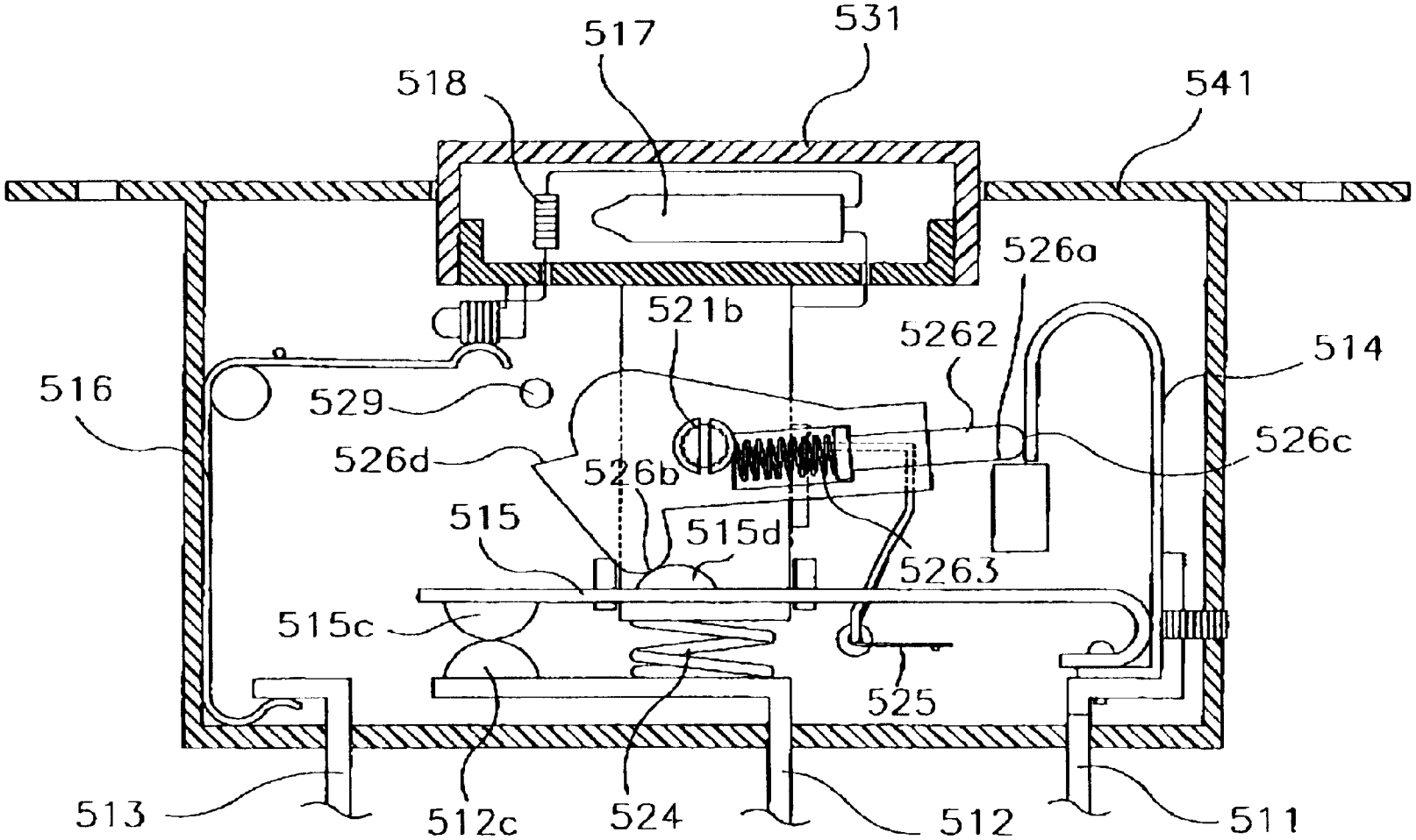
FIG. 15 is an assembled elevation view partly in section of the push-button switch of FIG. 14 in an ON status.
Figure 16:
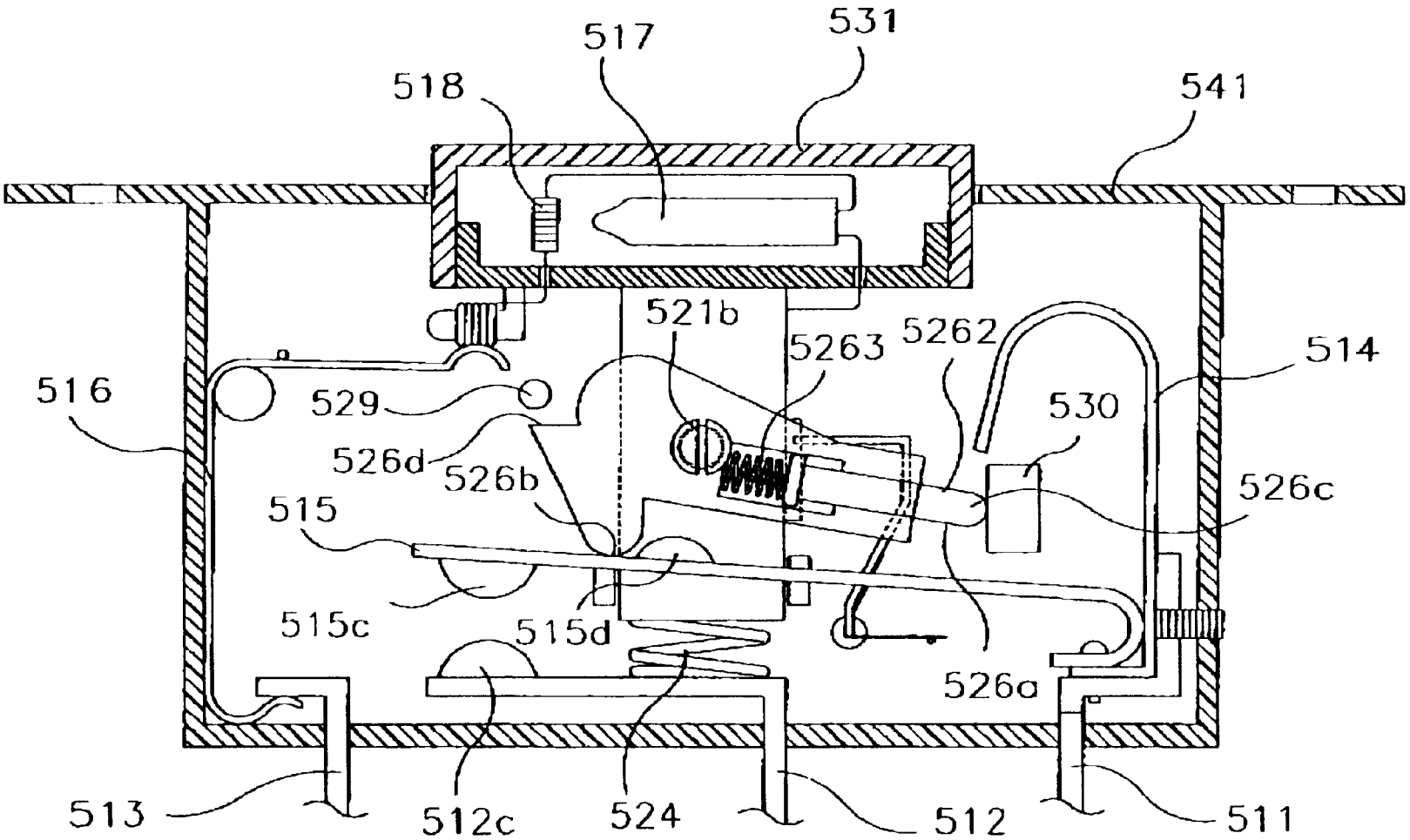
FIG. 16 is a view similar to FIG. 15 but in a trip status before the pressing stem returns to its reset position.

FIGS. 14 to 16 show an overload-protection push-button switch with a retractable mechanism in accordance with a fifth embodiment of this invention.

In comparison with the other embodiments, most of parts in this embodiment have substantially the same action as that of the corresponding parts in the other embodiments. Thus, the following description is directed to the changes in shape only. As shown in FIGS. 14 and 15, a sub-body 5262 in this embodiment is of a shape of a plug having a flat head.

The end portion of the plug, i.e. the sub-body 5262, serves as an abutting is portion 526*c* and a toe portion 526*a*. The body of the plug 5262 serves as a second joint. The main body 4261 is formed with a slot (not indicated) in replace with the shaft 426*h* in the fourth embodiment so as to receive a biasing spring 5263 and the plug-shaped sub-body 5262. The main body 5261 is also formed with a through hole, serving as a first joint, to receive the biasing spring 5263. The biasing spring 5263 abuts against and pushes the flat head of the plug-shaped sub-body 5262 to move rightward. The enabling supporter 530 extends from the cover 542 to a position in which the end portion, i.e., the toe portion, of the plug-shaped sub-body 5262 can be supported. The bimetallic blade 514 in this embodiment is of a U-shape opening downward. In case of overload, the bimetallic blade 514 will deform from a normal position as shown in FIG. 15 to an overload position as shown in FIG. 16. That is, the closed end of the bimetallic blade 514 will moves leftward. The pressing stem 521 has a tray 521*a* at its top portion for carrying the indicating lamp 517. The heart-shaped stepping recess 523 is formed in a right sidewall of the pressing stem 521. The cantilever 522 has one end fixed in the lower portion of the main shell 541 and another free end biased by a biasing spring 525 toward the recess 523.

By means of the above structure, the ON/OFF action of the switch according to this embodiment is substantially the same as that in the other embodiments. Its trip action is briefly described as follows. When the bimetallic blade 514 is in an overload position, the closed end of the bimetallic blade 514 will push the sub-body 5262 so that the biasing spring 5263 is compressed and the toe portion 526*a* is out of being supported. Owing to the elasticity of the first conducting leaf 515 itself, the rocker actuator 526 will rotate clockwise as shown in FIG. 16 and go into a disabled position. Later, when the switch is manually reset, the end portion of the sub-body 5262, i.e., the toe portion 526*a,* will rest on the enabling supporter 530 along with the moving-up of the pressing stem 521 and the engagement of the shoulder 526*d* with the actuator-reseating member 529. The rocker actuator 526 is thus enabled.

Figure 17A:
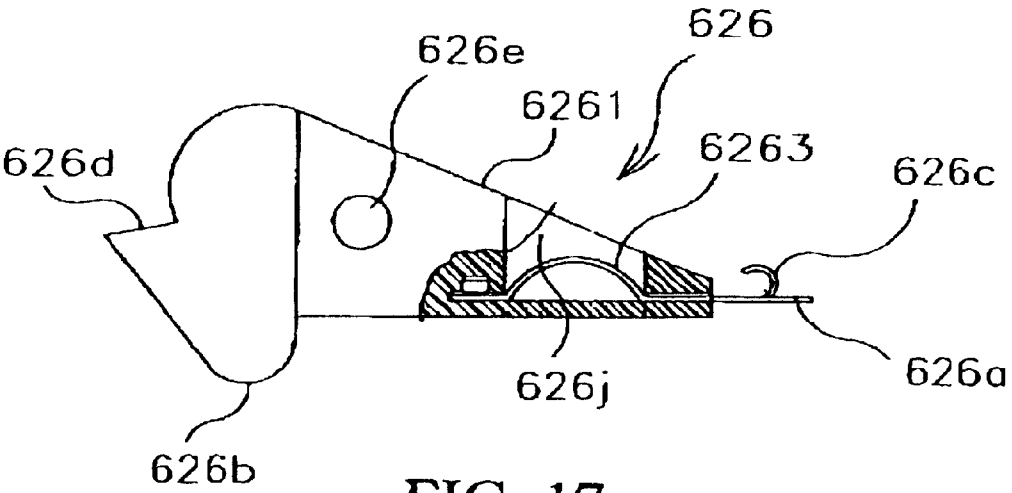
FIGS. 17A and 17B are partly broken side views of a rocker actuator according to a modification of the fifth embodiment of this invention in a retracted and non-retracted statuses respectively.
Figure 17B:
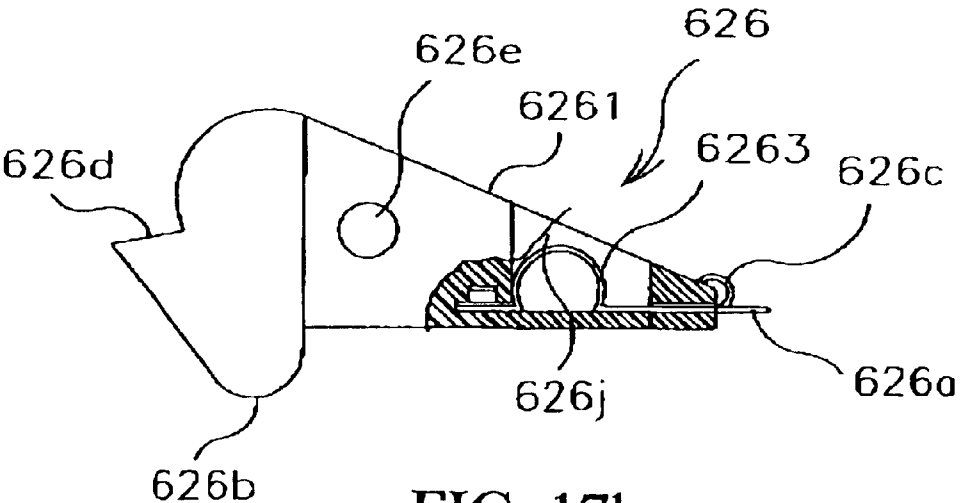

FIGS. 17*a* and 17*b* show a modification of the rocker actuator 526 in the fifth embodiment. In this modified embodiment, the rocker actuator 626 also comprises a main body 6261 and a sub-body, but the sub-body is incorporated into a biasing spring 6263 as one part made of metallic material, in comparison with the other embodiment. The main body 6261 is formed with a cavity 626*j* for receiving the biasing spring 6263. The biasing spring 6263 has one end to be fixed on the main body 6261, a flexible middle portion providing a retractable function, and another end formed with a toe portion 626*a* and an abutting portion 626*c*. The other end of the biasing spring 6263 extends outside of the main body 6261. The toe portion 626*a* extends longer than the abutting portion 626*c;* and the abutting portion 626*c* curves in a form of C-shape toward the main body 6261. By applying the rocker actuator 626 into the fifth embodiment, the same function and action as those of the fifth embodiment can be obtained. That is, the toe portion 626*a* can be supported by the enabling supporter 530 in case of a normal status, and the abutting portion 626*c* can be pushed by the bimetallic blade 514 in case of overload. The other action and function of this modified embodiment are substantially the same as those of the fifth embodiment and thus omitted herein only for simplifying description.

In sum, while the present invention is described by way of preferred embodiments, it is understood that the embodiments are used only to illustrate the technical concept of the present invention without limiting the scope thereof. It is therefore intended to show that all modifications and alterations that are readily apparent to those skilled in the art are within the scope as defined in the appended claims.

What is claimed is:

1. An overload-protection push-button switch with a retractable actuating mechanism comprises:

a housing;

a switching circuit installed in the housing and including a first terminal, a second terminal, a first conducting leaf, and a bimetallic blade; the bimetallic blade having a movable closed end, being able to move to an overload position from a normal position in case of overload, and an open end formed with a first and a second legs for respectively connecting the first terminal and the first conducting leaf; the first conducting leaf being movable between a conduction position in which the second leg of the bimetallic blade is electrically connected to the second terminal and a broken position in which the second leg is disconnected from the second terminal; and an actuating unit installed in the housing and including:

a slidable pressing stem to be actuated to one of a set and a reset positions;

a positioning unit including a cantilever and a heart-shaped stepping recess and being able to position the pressing stem in the set position when the pressing stem is pressed downward;

an enabling supporter provided on the housing;

a rocker actuator pivotally supported on the pressing stem, having a main body formed with a nose for abutting against the first conducting leaf, and a sub-body retractably coupling to the main body and formed with a toe portion to be supported by the enabling supporter, and an abutting portion to be pushed by the closed end of the metallic blade; and an actuator-reseating member for abutting against the rocker actuator during the returning course of the pressing stem back to its reset position so that the toe portion can move into a position to be supported by the enabling supporter;

whereby the toe portion could be enabled by the enabling supporter and the nose can make the first conducting leaf be alternatively located in its conduction position and its broken position in response to the location of the pressing stem in the set position and in the reset position respectively when the bimetallic blade is located in its normal position, and whereby the sub-body will retract so as to make the toe portion depart from the enabling supporter and to make the rocker actuator releases the first conducting leaf into a broken position in case of overload.

2. The switch as claimed in claim 1, wherein the rocker actuator further comprises a first joint in the main body, a second joint in the sub-body, and a biasing element for biasing the abutting portion of the sub-body to be far away from the main body.

3. The switch as claimed in claim 2, wherein the first joint is an axial hole, the second joint is a shaft, and the abutting portion allocates at one end of the sub-body, whereby the sub-body is biased around the shaft to a position to be supported.

4. The switch as claimed in claim 2, wherein the first joint is a pair of pins, the second joint is a pair of pin holes, the abutting portion allocates at a front side surface of the sub-body, and the toe portion is formed on a lower edge of the sub-body.

5. The switch as claimed in claim 2, wherein the sub-body is in a form of a crank having a shaft-shaped side and a slat-shaped side, the first joint is a box having an axial hole, the second joint is the shaft-shaped side of the crank, the toe portion is the slat-shaped side of the crank, whereby the sub-body is axially retractable with respect to the main body.

6. The switch as claimed in claim 2, wherein the first joint is a pair of shaft the second joint is a pair of guiding holes, the main body is further formed with a first recess, the sub-body is further formed with a second recess, the biasing spring is received in the first and the second recesses, whereby the sub-body is transversely retractable with respect to the main body.

7. The switch as claimed in claim 2, wherein the sub-body is in a form of a plug having a flat head and an end portion, the main body is formed with a slot and a through hole for receiving the biasing spring, the end portion serves as the toe portion and the abutting portion, and the flat head is biasing by the biasing spring.

8. The switch as claimed in claim 2, wherein the sub-body is integrated with the biasing spring and made by a metallic material, the biasing spring has one end to be fixed on the main body, a flexible middle portion providing a retractable function, and another end formed as the toe portion and the abutting portion.

* * * * *